US005464143A

United States Patent [19]

Hansen

[11] Patent Number: 5,464,143

[45] Date of Patent: Nov. 7, 1995

[54] WIDTH ADJUSTABLE ANGLE BAR ASSEMBLY FOR A PRINTING PRESS

[76] Inventor: Robert E. Hansen, 6340 Americana Dr., Clarendon Hills, Ill. 60514

[21] Appl. No.: 245,882

[22] Filed: May 18, 1994

Related U.S. Application Data

[63] Continuation of Ser. No. 45,544, Apr. 8, 1993, abandoned.

[51] Int. Cl.[6] ..... B65H 23/32

[52] U.S. Cl. ..... 226/199; 226/194; 226/197

[58] Field of Search ..... 226/196, 197, 226/199, 97

[56] References Cited

U.S. PATENT DOCUMENTS

| | | | |
|---|---|---|---|
| 2,989,265 | 6/1961 | Selsted | 226/21 X |
| 3,125,268 | 3/1964 | Bartholomay | 226/197 X |
| 3,599,851 | 8/1971 | Medlund et al. | 226/197 X |
| 3,679,116 | 7/1972 | Hamlin et al. | 226/199 X |
| 4,453,465 | 6/1984 | Heller et al. | 226/197 X |
| 4,925,077 | 5/1990 | Daane et al. | 226/97 |
| 5,016,801 | 5/1991 | Gilat et al. | 226/197 |
| 5,100,117 | 3/1992 | Majek et al. | 226/197 X |
| 5,316,199 | 5/1994 | Hansen et al. | 226/197 |

FOREIGN PATENT DOCUMENTS

| | | | |
|---|---|---|---|
| 1070201 | 6/1967 | United Kingdom | 226/197 |

*Primary Examiner*—Daniel P. Stodola
*Assistant Examiner*—William Stryjewski

[57] ABSTRACT

An adjustable angle bar assembly (10) for a printing press (12) having a support (14), a hollow angle bar (18) pivotally mounted adjacent a longitudinal central portion (34) of the angle bar (18) to the support (14), with the angle bar (18) having a cavity (20) for the passage of air, and a plurality of openings 30 extending through the angle bar (18) and communicating with the cavity (20) for passage of air through the angle bar (18) from the cavity (20) to a web (32) passing over the angle bar (18), a device for passing the air into the central portion (34) of the angle bar (18) for distribution of the air by the angle bar (18) against the web (32) irrespective of the orientation of the angle bar with respect to the support (14), and a device (40, 42 and 56) for modifying the effective length of the exposed openings (30) in the angle bar (18) communicating with the cavity (20).

4 Claims, 4 Drawing Sheets

WIDTH ADJUSTABLE ANGLE BAR ASSEMBLY FOR A PRINTING PRESS

CROSS-REFERENCE TO RELATED APPLICATION

This application is a continuation of application Ser. No. 08/045,544, filed Apr. 8, 1993, now abandoned.

This application is related to application Ser. No. 947,320, filed Sep. 18, 1992, incorporated herein by reference, now U.S. Pat. 5,316,199.

BACKGROUND OF THE INVENTION

The present invention relates to angle bar assemblies for a printing press.

In the past, printing presses have been provided with angle bars for directing or changing the path or motion of a paper web in the press. Such angle or turning bars have been provided with apertures through which air passes to cause some flotation of the web with respect to the angle bar as the web passes around the angle bar.

In the past, the air has been supplied near an end of the angle bar which has made it relatively difficult to change the direction of the angle bar in relationship to the press, since the source of air to the angle bar must also be changed. A web guiding system for a printing press has been disclosed in U.S. Pat. No. 5,100,117, which did not adequately solve the problem of directing air in a proper manner through the angle bar when the direction of the angle bar is changed.

In addition, the width of the web passing over the angle bar may be changed, and, in the case of a more narrow web, the openings may not be covered by the web. In this configuration, the air may vent through the uncovered end openings, such that a loss of pressure and inefficiency of the angle bar may take place in the press.

SUMMARY OF THE INVENTION

A principal feature of the present invention is the provision of an improved angle bar assembly of simplified construction.

The angle bar assembly of the present invention comprises, a support, a hollow angle bar pivotally mounted adjacent a longitudinal central portion of the angle bar to the support, with the angle bar having a cavity for the passage of air, a plurality of openings extending through the angle bar and communicating with the cavity for passage of air through the angle bar from the cavity to a web passing over the angle bar, and means for passing air into a longitudinal central portion of the angle bar for distribution of the air by the angle bar against the web irrespective of the orientation of the angle bar with respect to the support.

A feature of the invention is the provision of means for modifying the effective length of the exposed openings in the angle bar communicating with the cavity.

In a preferred form, the modifying means closes at least one end portion of the angle bar from communication with the cavity to prevent passage of air through the openings in an outer end portion of the angle bar.

Yet another feature of the invention is that both opposed end portions of the angle bar may be closed from communication with the cavity to prevent passage of air through the openings in both end portions of the angle bar.

Still another feature of the invention is that the modifying means may separately close both opposed end portions of the angle bar.

Another feature of the invention is that both end portions of the angle bar may be simultaneously closed by the modifying means.

A feature of the invention is that the modifying means may comprises a plate slidably received in at least one end portion of the angle bar, with the plate having a threaded opening passing through the plate, and a threaded bar passing through the threaded opening of the plate to change the position of the plate inwardly and outwardly in the angle bar.

Another feature of the invention is that the modifying means may include a pair of plates slidably mounted in both opposed end portions of the angle bar, with both of the plates having a threaded opening passing through the respective plates, and with a threaded shaft extending through the openings of the plates to change the position of the plates inwardly and outwardly in the angle bar dependent upon the direction of rotation of the shaft.

Thus, a feature of the present invention is that openings in the opposed end portions of the angle bar may be selectively closed from the air passing into the cavity of the angle bar.

A further feature of the invention is that the opposed plates may be readily adjustable to the width of the web corresponding to webs of varying widths.

Another feature of the invention is that the angle bar assembly prevents the loss of air passing through openings in the angle bar and being located outside the opposed edges of the web.

Yet another feature of the invention is that the angle bar assembly results in increased efficiency of the air which effectively passes only against the web passing over the angle bar.

Further features will become more fully apparent in the following description of the embodiments of this invention, and from the appended claims.

DESCRIPTION OF THE PREFERRED EMBODIMENTS

Figure 1:
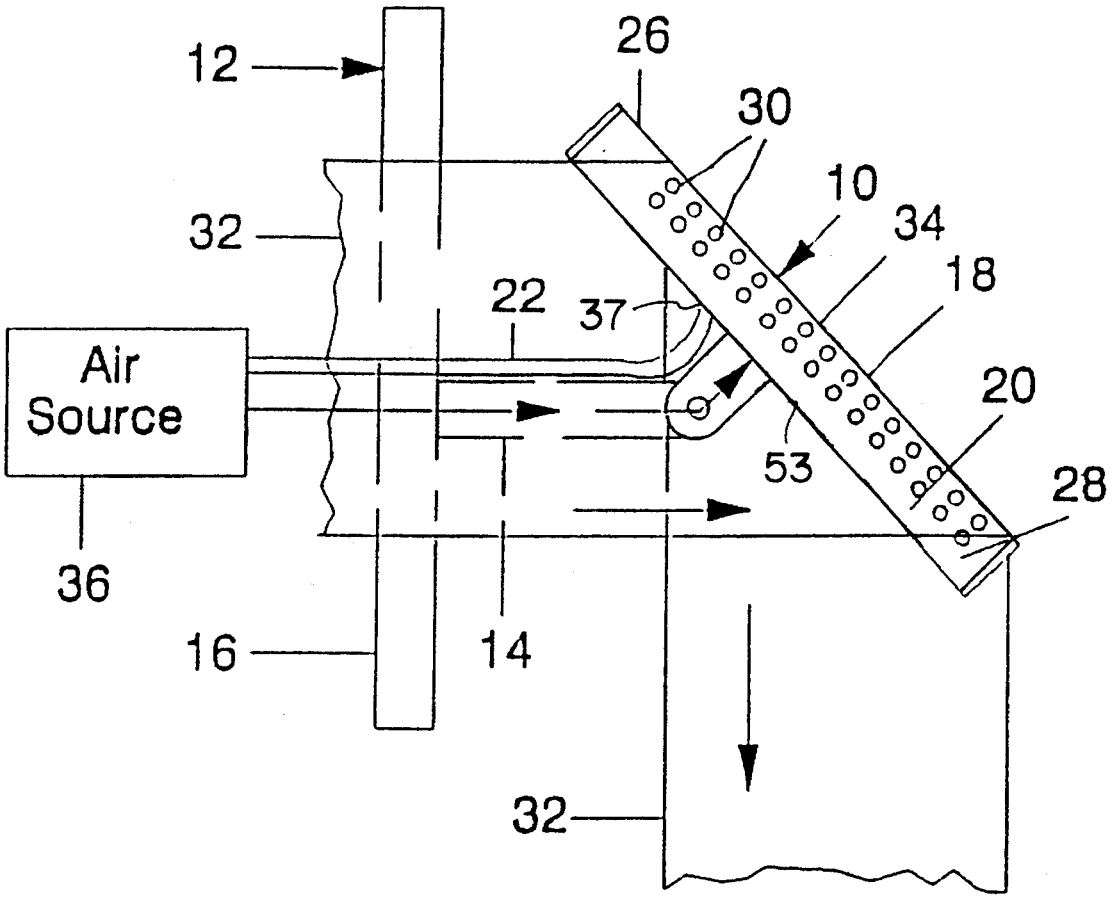
FIG. 1 is a diagrammatic plan view of an angle bar assembly for directing a web in a printing press.
Figure 2:
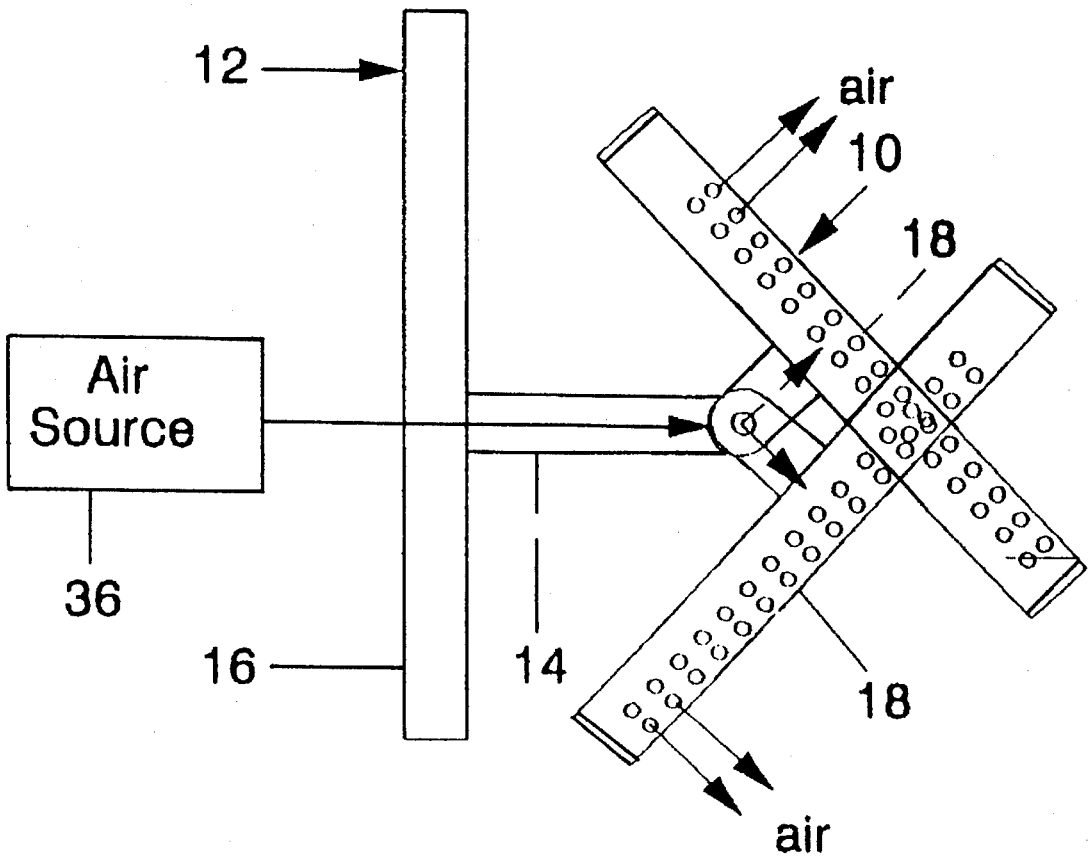
FIG. 2 is a diagrammatic plan view of the angle bar assembly of FIG. 1, with an angle bar of the assembly being in different configurations.

Referring now to FIGS. 1 and 2, there is shown an angle bar assembly generally designated 10 for a printing press generally designated 12. The angle bar assembly 10 may have a bracket 14 extending from a plate or wall 16 of the press 10. The angle bar assembly 10 has an elongated hollow angle bar or turning bar 18 having a cavity 20 and extending between opposed end portions 26 and 28 of the angle bar 18. The angle bar 18 has a plurality of apertures 30 extending through the angle bar 18 and communicating between the cavity 20 and the atmosphere in order to permit passage of air from the cavity 20 against a paper web 32 passing over the angle bar 18 to provide a cushion by the air for the web 32 as it passes over the angle bar 18.

As shown, the angle bar 18 is pivotally mounted to the bracket 14, such that the angle bar 18 may be moved between first and second separate positions approximately 90 degrees apart, as shown in FIG. 2. The air passes through the bracket 14 and into a longitudinal central portion 34 of the angle bar 18 from a source of air 36 without the necessity of changing the air connection to the angle bar assembly 10 when the bar 18 is moved to different positions, as disclosed in application Ser. No. 947,320, filed Sep. 18, 1992, incorporated herein by reference. In an alternative form, the air may pass through a hollow flexible conduit 22 from the source 36 to the cavity 20 in a central portion of the bar 18, such that the conduit 22 flexes when the bar 18 is moved between alternative positions. The air enters an air inlet opening 37, FIG. 1, passing through a sidewall 53 of the angle bar 18 and into the central portion of the cavity 20 for distribution of the air by the angle bar against the web 32. Although the invention will be described in connection with the use of air, it will be understood that any other suitable gas may be used, and the term air will be construed to include such gas.

Figure 3:
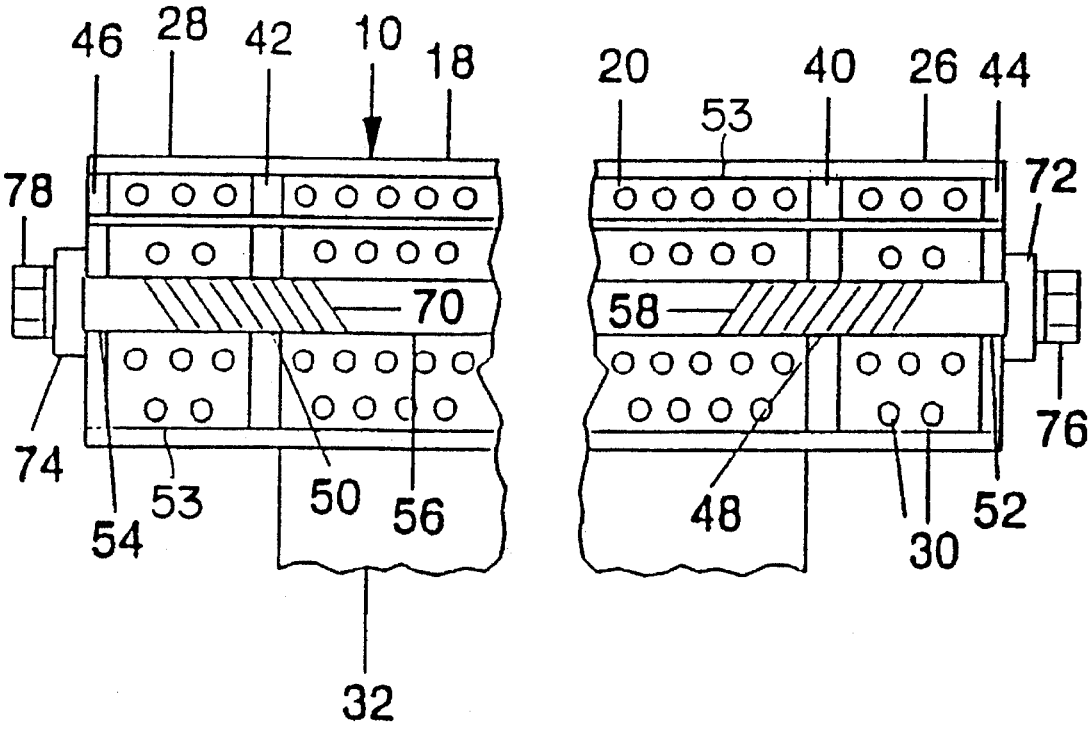
FIG. 3 is a fragmentary sectional view of one embodiment of the angle bar assembly of the present invention.

As shown in FIG. 3, the assembly 10 has a first plate 40 slidably mounted in the cavity 20 in the first end portion 26 of the angle bar 18, such that the first plate 40 closes the cavity 20 in the first end portion 26 of the angle bar 18. The assembly 10 also has a second plate 42 slidably mounted in the cavity 20 of the second end portion 28 of the angle bar 18, such that the second plate 42 closes the cavity 20 in the second end portion 28 of the angle bar 18. The angle bar 18 has a sidewall 53 surrounding the elongate cavity 20 with central portion 34, FIG. 1, between the pair of opposed ends 26, 28, FIG. 3, and the openings 30 extending along the entire length of the elongate cavity between the ends. The angle bar assembly 10 also has a pair of first and second fixed plates 44 and 46 respectively closing the cavity 20 in the first and second end portions 26 and 28 at the outer opposed ends of the angle bar 18.

The first slidable plate 40 has a first threaded opening or aperture 48 extending through the first plate 40, and the second plate 42 has a threaded opening or aperture 50 extending through the second plate 42. The first fixed plate 44 has a bore 52 extending through the first fixed plate 44 and being aligned with the first threaded opening 48, and the second fixed plate 46 has a bore 54 extending through the second fixed plate 46 and being aligned with the second threaded opening 50.

As shown, the angle bar assembly 10 has an elongated threaded shaft 56 rotatable mounted in the bores 52 and 54 in the opposed first and second fixed plates 44 and 46, such that the shaft 56 is rotatable mounted in the angle bar 18. The shaft 56 has a set of first threads 58 received in the first threaded opening 48 of the first slidable plate 40, and the shaft 56 has a set of second threads 70 received in the second threaded opening 50 of the second slidable plate 42. The angle bar 18 has a first washer 72 disposed on the shaft 56 outside the first fixed plate 44, and a second washer 74 disposed on the shaft 56 outside the second fixed plate 46 of the angle bar 18. The shaft 56 has a pair of opposed first and second faceted shaft heads 76 and 78, respectively, such that the shaft 56 may be rotated in the angle bar 18 through use of a suitable wrench on either of the shaft heads 76 and 78.

As shown, the first and second threads 58 and 70 are disposed in opposed directions on the shaft 56, such that rotation of the shaft 56 in one rotational direction causes simultaneous movement of both the first and second plates 40 and 42 inwardly in the angle bar 18, and such that rotational movement of the shaft 56 in the opposite rotational direction causes simultaneous movement of both the first and second plates 40 and 42 outwardly in the angle bar 18. In this manner, the longitudinal positions of the first and second plates 40 and 42 may be longitudinally modified in the cavity 20 of the angle bar 18 in correspondence with webs 32 of differing widths, such that the apertures 30 located outside the width of the web 32 may be closed from communication with the air passing into the cavity 20 of the angle bar 18. Thus, the adjusted plates 40 and 42 define the effective width of operating apertures 30 in the angle bar 18, such that nearly all the apertures 30 exposed to the source of air in the cavity 20 are located beneath the web 32 passing over the angle bar 18. The pair of blocking members or plates 40 and 42 slidably mounted adjacent both opposed ends 26, 28 of the angle bar 18 selectively block air within the central portion of the cavity 20 from passing through the openings 30 located adjacent the pair of opposed ends.

Thus, the adjusted angle bar assembly 10 prevents the passage of air through the apertures 30 which are located outside the effective width of the web 32 in order to prevent loss of pressure in the cavity 20, and increase the efficiency of the device 10. The plates 40 and 42 are simultaneously adjustable in a simplified manner through rotation of the shaft 56 in opposite directions by utilizing a suitable wrench placed over the first or second shaft head 76 or 78 and rotating the shaft 56 in opposite directions depending upon whether it is desired to move the plates 40 and 42 inwardly and outwardly in the angle bar 18. Rotation of the shaft 56 symmetrically adjusts the movement of both the pair of blocking members 40 and 42 toward and away from each other to selectively control the number of openings 30 adjacent the opposed ends 26, 28 communicating with the air received from the air inlet opening 37, FIG. 1, and passing into the central portion of the cavity 20.

Figure 4:
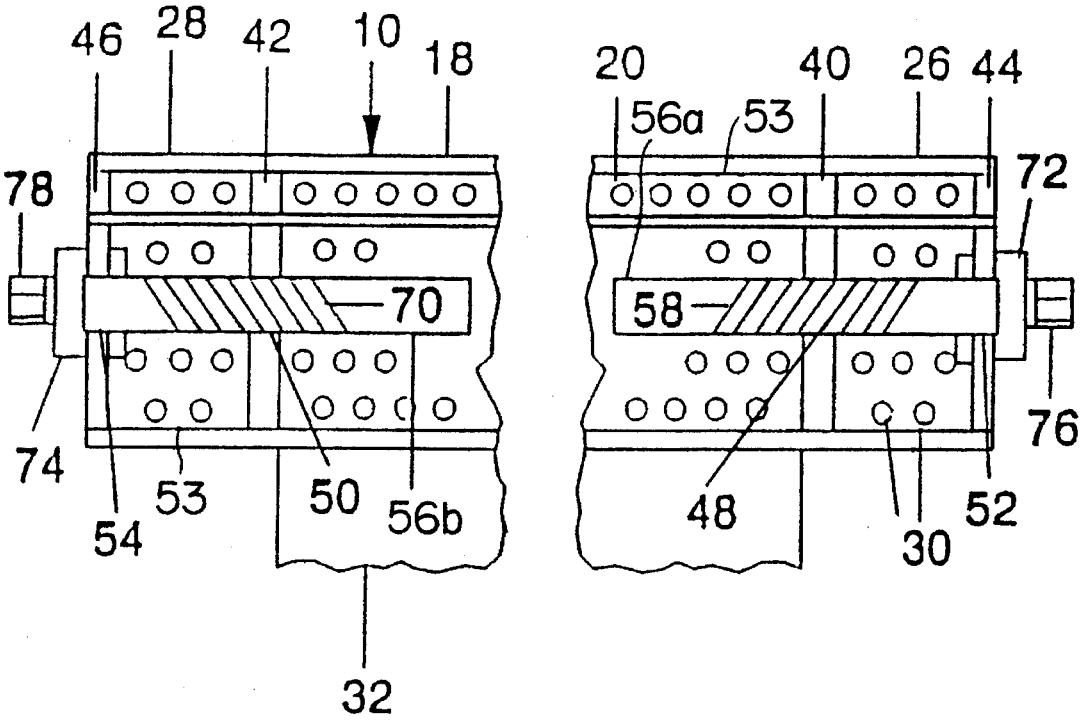
FIG. 4 is a fragmentary sectional view of another embodiment of the angle bar assembly of the present invention.

Another embodiment of the present invention is illustrated in FIG. 4, in which like reference numerals designate like parts. In this embodiment, the angle bar assembly 10 has a pair of first and second shafts **56*a* and 56*b* which replace the single shaft 56 in the embodiment of FIG. 3. The first shaft 56*a* is rotatably mounted in the first fixed plate 44 and is supported by the plate 40 in the cavity 20, and the second shaft 56*b* is rotatably mounted in the second fixed plate 46 and is supported by the plate 42 in the cavity 20, with the first and second threads 58 and 70 being disposed in opposite directions in the cavity 20, and with the first and second plates 40 and 42 being located on the threaded portions of the shafts 56*a* and 56*b***.

Thus, in this embodiment, the first and second plates 40 and 42 are separately adjustable inwardly or outwardly through rotation of the respective shafts **56*a* and 56*b* through use of suitable wrench on the respective first and second shaft heads 76 and 78. In this manner, the first and second plates 40 and 42 are separately adjustable in the cavity 20 of the angle bar 18 in order to close apertures 30 from communication with the air in the cavity 20, and thus adjust the plates 40 and 42 depending upon the width of the web 32 and the position of the web laterally along the angle bar 18. In other respects, the embodiment of FIG. 4 operates in a manner similar to the angle bar assembly 10 previously described in connection with FIGS. 1–3**.

The foregoing detailed description has been given for clearness of understanding only, and no unnecessary limitations should be understood therefrom, as modifications will be obvious to those skilled in the art.

What is claimed is:

1. A width adjustable angle bar assembly for a printing press, comprising:

a support;

a hollow angle bar mounted on the support, said angle bar having a cavity with a central portion between a pair of opposed ends, and a plurality of openings extending through the angle bar and communicating with the cavity for passage of air through the angle bar from the cavity to a web passing over the angle bar;

means for passing the air into the central portion of the cavity for distribution of the air by the angle bar against the web;

a pair of blocking members slidably mounted adjacent both opposed ends of the angle bar, respectively, for blocking the passage of air from the central portion of the cavity through the openings adjacent the ends; and means for symmetrically adjusting the movement of the blocking members toward and away from each other to selectively control the number of openings adjacent the opposed ends communicating with the air passing into the central portion of the cavity.

2. The angle bar assembly of claim 1 wherein the symmetrically adjusting means simultaneously adjusts the position of the pair of blocking members in the cavity of the angle bar.

3. The angle bar assembly of claim 1 wherein the symmetrically adjusting means includes a pair of plates slidably mounted adjacent the opposed ends of the angle bar assembly, with the plates having threaded openings extending through the plates, and a threaded bar extending through the plate openings such that rotational movement of the threaded bar changes the longitudinal position of both the pair of plates inward and outward in the cavity of the angle bar assembly dependent upon the direction of rotation of the threaded bar.

4. The angle bar assembly of claim 1 wherein the symmetrically adjusting means comprises a pair of first and second plates slidably mounted in the cavity in opposed end portions of the angle bar, with each of the plates including a threaded opening extending through the respective plates, and including a threaded shaft extending through the threaded openings of the first and second plates, such that rotational movement of the shaft simultaneously adjusts the positions of the first and second plates inward or outward in the cavity of the bar assembly depending upon the direction of rotation of the shaft.

* * * * *